US011117023B2

(12) United States Patent
Nagao et al.

(10) Patent No.: US 11,117,023 B2
(45) Date of Patent: Sep. 14, 2021

(54) BALL

(71) Applicant: MOLTEN CORPORATION, Hiroshima (JP)

(72) Inventors: Yukinori Nagao, Hiroshima (JP); Ryo Kurahashi, Hiroshima (JP); Kazuyuki Wakibayashi, Hiroshima (JP)

(73) Assignee: MOLTEN CORPORATION, Hiroshima (JP)

( * ) Notice: Subject to any disclaimer, the term of this patent is extended or adjusted under 35 U.S.C. 154(b) by 0 days.

(21) Appl. No.: 16/307,381

(22) PCT Filed: Jul. 12, 2017

(86) PCT No.: PCT/JP2017/025367
§ 371 (c)(1),
(2) Date: Dec. 5, 2018

(87) PCT Pub. No.: WO2018/012521
PCT Pub. Date: Jan. 18, 2018

(65) Prior Publication Data

US 2019/0358499 A1 Nov. 28, 2019

(30) Foreign Application Priority Data

Jul. 12, 2016 (JP) ..... JP2016-138060

(51) Int. Cl.
*A63B 41/08* (2006.01)

(52) U.S. Cl.
CPC ..... *A63B 41/08* (2013.01); *A63B 2209/00* (2013.01)

(58) Field of Classification Search
CPC ..... A63B 41/08; A63B 2209/00; A63B 41/00; A63B 43/00; A63B 39/06; A63B 2225/60; A63B 41/02
See application file for complete search history.

(56) References Cited

U.S. PATENT DOCUMENTS 1,531,317 A * 3/1925 Stubbs ..... A63B 39/00 473/609
1,923,236 A * 8/1933 Sonnett ..... A63B 41/08 473/599

(Continued)

FOREIGN PATENT DOCUMENTS

CN 1761502 A 4/2006
CN 104208734 A * 12/2014

(Continued)

OTHER PUBLICATIONS

International Search Report; PCT/JP2017/025367; dated Oct. 4, 2017.

(Continued)

*Primary Examiner* — Steven B Wong
(74) *Attorney, Agent, or Firm* — Parsons Behle & Latimer

(57) ABSTRACT

The ball of the present invention is characterized by including at least one skin layer having water absorbability. The at least one skin layer may be formed of a water absorbent material, or may be formed so as to include a surface portion and a water absorbent outer skin adhered to at least a part of the surface portion. According to the ball of the present invention, a ball for competitions that can easily maintain water absorbency is provided while remaining durable even when used for a long time and not requiring man-hours during the manufacturing process.

20 Claims, 6 Drawing Sheets

(56) References Cited

U.S. PATENT DOCUMENTS 1,964,008 A * 6/1934 Roberts ..... A63B 39/00 473/609
2,294,424 A * 9/1942 Roberts ..... B29D 22/04 473/605
2,364,247 A * 12/1944 Shearer ..... F16K 15/202 473/610
3,119,618 A * 1/1964 Molitor ..... A63B 41/00 473/599
3,185,476 A * 5/1965 Fechner ..... A63B 43/02 473/596
4,462,590 A * 7/1984 Mitchell ..... A63B 41/08 273/DIG. 8
5,040,795 A * 8/1991 Sonntag ..... C09D 5/00 473/596
5,181,717 A * 1/1993 Donntag ..... A63B 41/08 264/257
5,413,331 A * 5/1995 Stillinger ..... A63B 39/06 473/599
5,580,049 A 12/1996 Brantley
5,772,545 A * 6/1998 Ou ..... A63B 41/00 156/170
5,865,697 A * 2/1999 Molitor ..... A63B 41/00 473/604
6,024,661 A * 2/2000 Guenther ..... A63B 41/08 473/599
6,503,162 B1 * 1/2003 Shishido ..... A63B 41/08 473/599
6,645,099 B2 * 11/2003 Gaff ..... A63B 41/08 473/596
6,726,583 B1 * 4/2004 Lai ..... A63B 41/10 473/599
7,566,488 B2 7/2009 Mimura et al.
7,648,434 B2 * 1/2010 Nagao ..... A63B 39/06 473/604
8,388,476 B2 * 3/2013 Ou ..... A63B 41/08 473/605
8,512,177 B2 * 8/2013 Krysiak ..... A63B 24/0021 473/570
8,622,857 B2 * 1/2014 Lo ..... A63B 41/10 473/604
8,926,459 B2 * 1/2015 Berggren ..... A63B 41/00 473/604
9,101,802 B2 * 8/2015 Hussain ..... B32B 7/12
9,186,559 B1 * 11/2015 Hussain ..... A63B 41/08
10,029,155 B1 * 7/2018 Lo ..... A63B 41/02
2002/0077202 A1 * 6/2002 Guenther ..... A63B 41/00 473/604
2002/0091025 A1 * 7/2002 Guenther ..... A63B 41/00 473/604
2003/0073527 A1 * 4/2003 Ou Chen ..... A63B 41/00 473/604
2006/0199686 A1 * 9/2006 Mimura ..... A63B 39/06 473/605
2009/0186724 A1 * 7/2009 Ashida ..... A63B 41/08 473/607
2011/0111896 A1 * 5/2011 Frazier ..... A63B 39/06 473/604
2012/0142465 A1 * 6/2012 Berggren ..... A63B 41/08 473/604
2014/0274504 A1 * 9/2014 Hu ..... A63B 39/00 473/604
2016/0310802 A1 * 10/2016 Wakibayashi ..... A63B 41/08
2019/0309464 A1 * 10/2019 Caswell ..... D06F 60/00

FOREIGN PATENT DOCUMENTS

DE 112008001626 B4 12/2017
JP 2002159597 A * 6/2002
JP 2004300656 A 10/2004
JP 2011-240032 A 12/2011
WO WO2015099185 3/2017
WO WO2015099186 3/2017

OTHER PUBLICATIONS

State Intellectual Property Office of People's Republic of China; Office Action issued in Chinese Patent Application No. 201780033319.6; dated Nov. 29, 2019.
Japan Patent Office; Office Action issued in Japanese Patent Application No. 2018-516857; dated May 31, 2018.
Japan Patent Office; ssued in Japanese Patent Application No. 2018-516857; dated Aug. 22, 2018.
European Patent Office; Extended European Search Report; European Patent Application No. 17827648.8 dated Jan. 27, 2020.
Republic of China Patent Office; 2nd Office Action; JP Patent Application No. 2018-516857; dated May 29, 2020.
The State Intellectual Property Office of the People's Republic of China; Chinese Patent Application No. 201780033319.6; 3rd Office Action dated Aug. 20, 2020.

* cited by examiner

BALL

TECHNICAL FIELD

The present invention relates to balls, particularly balls for ball games.

BACKGROUND ART

Conventionally, using artificial leather as a skin layer for hand-based competition balls such as handballs, volleyballs, beach volleyballs, basketballs, and rugby balls is known (see, for example, Patent Document 1). Generally, when the surface of the ball becomes wet such as by sweat or rain, it starts slipping and enters a state in which play cannot be done accurately.

In response to this situation, Patent Document 1 discloses providing a skin material for balls which has little change in the weight and handling properties while having a good grip feeling regardless of the state of perspiration of the hands by providing a skin material for balls in which a porous coating layer comprising a polymeric elastomer and not containing a water repellent agent is formed on the surface of a substrate layer comprising fibers, a polymer elastomer and a water repellent agent and in which the surface of the coating layer has an opening.

However, in Patent Document 1, there is a problem that since the coating layer is formed by applying a coating, the man-hours required during the manufacturing process is increased and the durability with respect to long-term use is low.

PRIOR ART DOCUMENT

Patent Document

[Patent Document 1] Japanese Laid-open Patent Publication No. 2011-240032

DISCLOSURE OF INVENTION

Problem to be Solved by the Invention

The present invention has been made in view of the above-described problems, and an object of the present invention is to provide a ball for competitions which can easily maintain water absorbency while not taking man-hours and is durable even when used for a long time.

Means to Solve the Problem

In order to achieve the above object, the present invention is grasped by the following configurations.

(1) A first embodiment of the present invention is a ball comprising a skin layer having water absorbability.

(2) In the above embodiment (1), the skin layer is formed of a water absorbent material.

(3) In the above embodiment (2), the water absorbent material is formed of polyurethane resin.

(4) In the above embodiment (2), the water absorbent material is formed of a water absorbent polymer or a hydrophilic polymer.

(5) In the above embodiment (2), the water absorbent material is porous.

(6) In the above embodiments of any one of (2) to (5), the water absorbent material has a bottomed recessed portion.

(7) In the above embodiment (1), the skin layer includes a surface portion, and a water absorbent outer skin adhered to at least a part of the surface portion.

(8) In the above embodiment (7), the water absorbent outer skin is adhered to the entire surface of the surface portion.

(9) In the above embodiments of either (7) or (8), the water absorbent outer skin is made of polyurethane resin.

(10) In the above embodiment (7), the water absorbent outer skin is formed of a water absorbent polymer or a hydrophilic polymer.

(11) In the above embodiment (7), the water absorbent outer skin is porous.

(12) In the above embodiments of any one of (7) to (11), the water absorbent outer skin has a bottomless recessed portion.

(13) In the above embodiment (1), the skin layer has a surface portion and a peripheral wall portion extending downward from a peripheral edge of the surface portion.

(14) In the above embodiment (13), the skin layer has an extending portion extending from the peripheral wall toward the center.

(15) In the above embodiment (1), the ball is a glued ball in which a plurality of skin layers are adhered together.

(16) In the above embodiments of either (1) or (15), a hollow tube is further provided, and the skin layer constitutes an outer layer of the tube.

(17) In the above embodiment (16), the tube is composed of a plurality of partitioned bodies welded or adhered together.

(18) The above embodiments of (16) or (17) above further comprising a reinforcing layer provided between the tube and the skin layer.

Advantage of the Invention

The present invention is able to provide balls for competitions that are able to easily maintain water absorbency while not require man-hours in the manufacturing process, and are durable even when used for a long time.

BEST MODE FOR CARRYING OUT THE INVENTION

Figure 1:
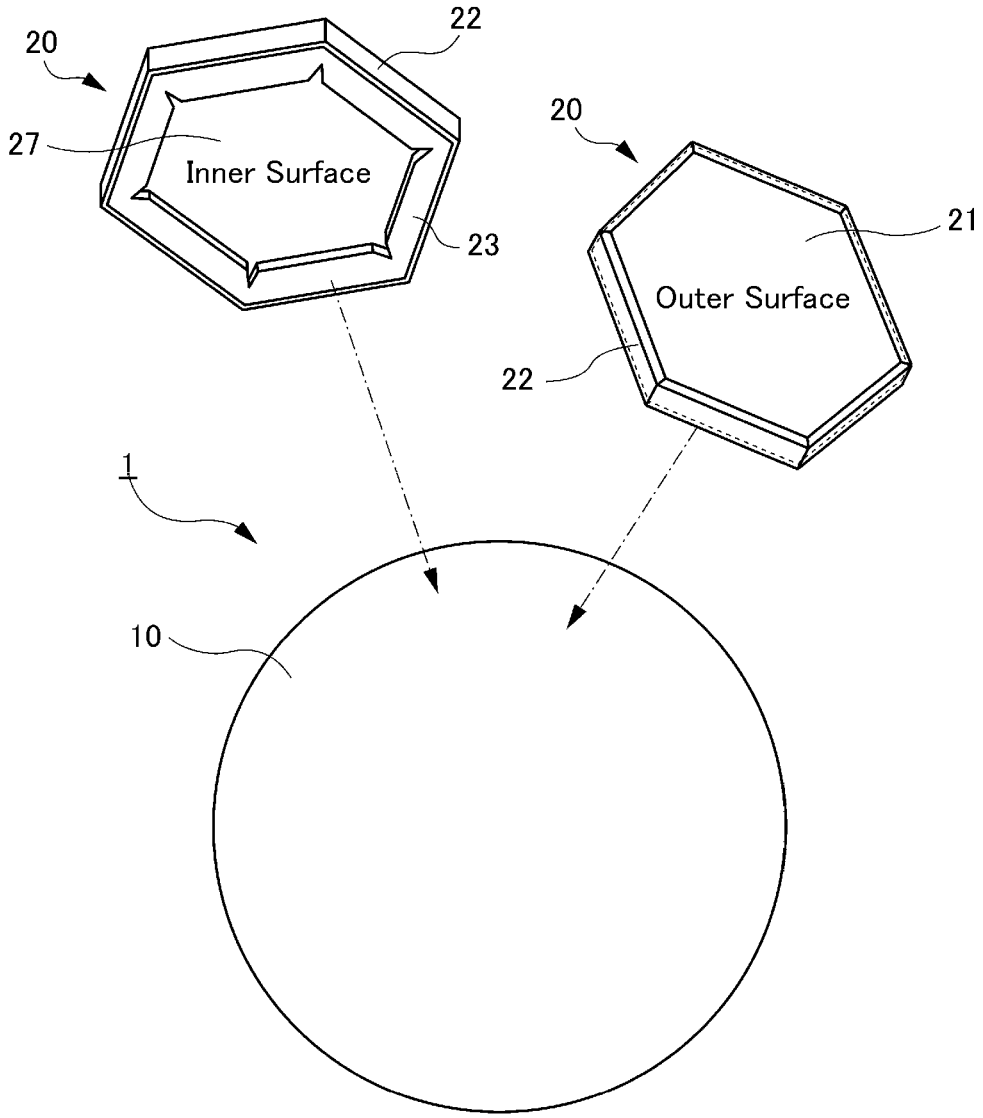
FIG. 1 is a perspective view of a ball according to an embodiment of the present invention.

Hereinafter, modes for carrying out the present invention (hereinafter referred to as "embodiments") will be described in detail with reference to the accompanying drawings. In the following description, a handball will be used as an example, but the application of this embodiment is not limited to a handball, but rather may be any hand-based competition ball such as a volleyball, a beach volleyball, a basketball, or a rugby ball. Note that the same reference numerals are attached to the same elements throughout the description of the embodiments.

(Overall Structure of the Ball)

As shown in FIG. 1, the ball 1 includes a hollow tube 10 and a skin layer 20 constituting an outer layer of the tube 10. Each will be described below.

(Tube)

In the tube 10, compressed air is enclosed by a predetermined pressure based on the rules of the competition. The tube 10 is made of an elastic material having which is impermeable to air such as, for example, butyl rubber or latex rubber, and has a rubber valve (not shown) of a well-known structure. This valve is exposed on the outer surface and compressed air is injected into the tube 10 via the valve, but the structure of the valve can be adopted to any well-known type. In FIG. 1, a spherical hollow tube 10 is shown as the handball tube 10, but in the case of a rugby ball, an American football, or the like, the tube 10 may be a hollow ellipsoid. In this case, a ball 1 having a tube 10 is described, but depending on the use of the ball 1 (for example, such as for a child's toy), a plurality of skin layers 20 may be adhered to each other without providing the tube 10.

(Skin Layer)

The skin layer 20 is configured to cover the tube 10 either directly or indirectly via a reinforcing layer 30 (described later) or the like.

In FIG. 1, a hexagonal planar shape is shown as one unit of the skin layer 20. When the ball 1 is a handball, the illustrated hexagonal and unillustrated pentagonal skin layers 20 can be combined with each other to cover the tube 10 in many ways, but of course, the present invention is not limited to these aspects, and other shapes may be used.

The skin layer 20 is made of a soft material made of thermoplastic resin, thermosetting resin or rubber and can be molded by a molding method such as injection molding, press molding, vacuum molding, blow molding or the like. FIG. 1 discloses that the skin layer 20 includes a surface portion 21, a peripheral wall portion 22 extending from the peripheral edge of the surface portion 21 toward the tube 10, and an extending portion 23 extending from the peripheral wall portion 22 toward the center. Further, the space surrounded by the surface portion 21, the peripheral wall portion 22, the extruding portion 23, and the tube 10 is the cavity portion 27.

Figure 2A:
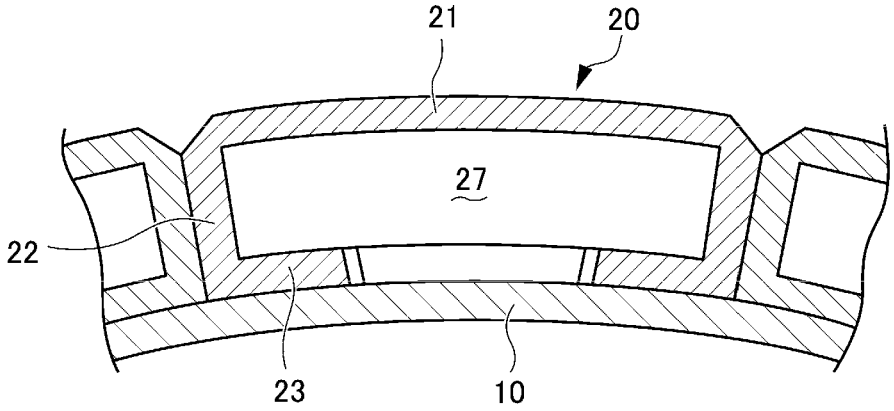
FIG. 2 illustrates various states regarding FIG. 1 in which the skin surface is formed by adhering (adhered ball) wherein (a) shows a case in which the skin surface is formed of a water absorbent material, (b) shows a case in which a water-absorbent outer skin is formed on a part of the surface of the surface portion of the skin surface, and (c) shows a case in which a water-absorbent outer skin is formed on the entire surface of the surface portion of the skin surface.
Figure 2B:
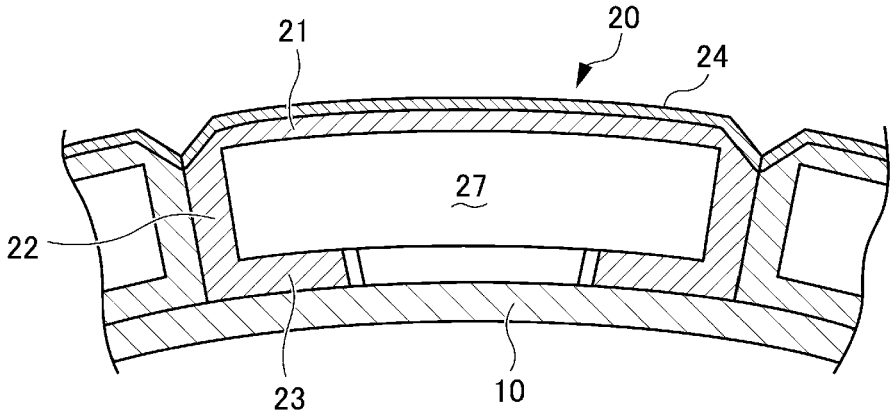
Figure 2C:
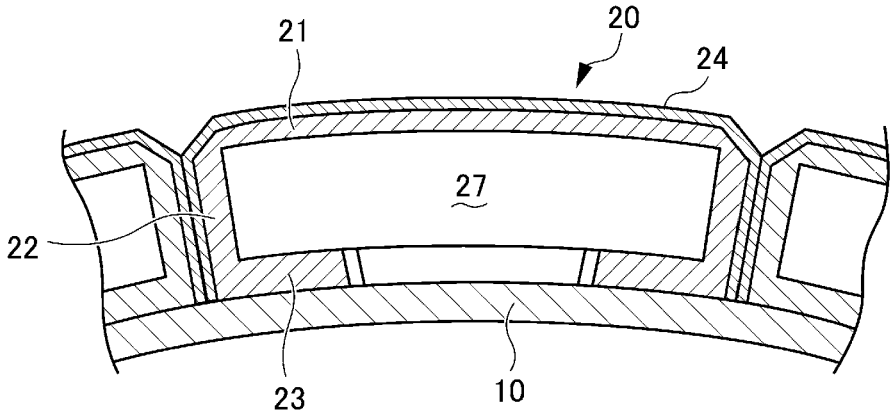

The relationship between the tube 10 and the skin layer 20 will be described in more detail with reference to FIG. 2. FIG. 2(*a*) shows a cross section when a skin layer 20 is adhered to the surface of the tube 10. Specifically, an extending portion 23 which is bent from the peripheral wall portion 22 toward the center is attached to the surface of the tube 10. The peripheral wall portions 22 of the adjacent skin layers 20 are also adhered together. As described above, the skin layer 20 is formed in a hexagonal or pentagonal planar shape, but the adjacent skin layers 20 are adhered to each other regardless of the planar shape.

Since the extending portion 23 is provided in this manner, the area in which the skin layer 20 is adhered to the tube 10 can be increased, and when the ball 1 is a glued ball, improving the adhesion strength becomes possible. The peripheral wall portion 22 of the adjacent skin layers 20 are adhered as described above.

(Water Absorbency)

The ball 1 according to the present embodiment aids in accurate play and enables the demonstration of one's ability by absorbing sweat, water, etc., so that the hands of the player grasping the ball do not slip. From this viewpoint, the skin layer 20 has water absorption properties such as with the following configurations.

First, a first embodiment related to water absorbability can be configured as shown in FIG. 2(*a*). In this case, the skin layer 20 itself is formed from a water absorbing material, so that water absorbing properties are imparted. An example of a preferable material to use is polyurethane resin. When the polyurethane resin is made porous, moisture on the surface of the skin layer 20 is absorbed within several seconds. Also, based on the same viewpoint, the material may be composed of a porous water-absorbent polymer or a hydrophilic polymer.

Next, a second embodiment may be configured as shown in FIG. 2(*b*). In this case, a water absorbent outer skin 24 is affixed to the entire surface of the skin layer 20, thereby imparting water absorbency. For example, a polyurethane resin formed into a grip tape shape can be used as the water absorbent outer skin 24 and attached to the entire surface of the skin layer 20. In this configuration, the skin layer 20 is formed by conventional materials and manufacturing methods, and the entire surface thereof is covered with a separate water absorbent outer skin 24. Note that the water absorbent outer skin 24 may be made of a porous water-absorbing polymer or a hydrophilic polymer like with the above-mentioned material (this also applies to the following embodiments 3 to 7).

Next, a third embodiment may be configured as shown in FIG. 2(*c*). In this case, the water absorbent outer skin 24 is attached to the surface portion 21 and the peripheral wall portion 22 of the skin layer 20. As with the second embodiment, for example, a polyurethane resin formed into a grip tape shape can be used as the water absorbent outer skin 24. In the third embodiment, the surface portion 21 and the peripheral wall portion 22 of the skin layer 20 are covered with the water absorbent outer skin 24; moreover, moisture such as perspiration hardly permeates into the tube 10 side through the gap between the skin layers 20 since the water absorbent outer skin 24 corresponding to the peripheral wall portions 22 adhered together.

Figure 3:
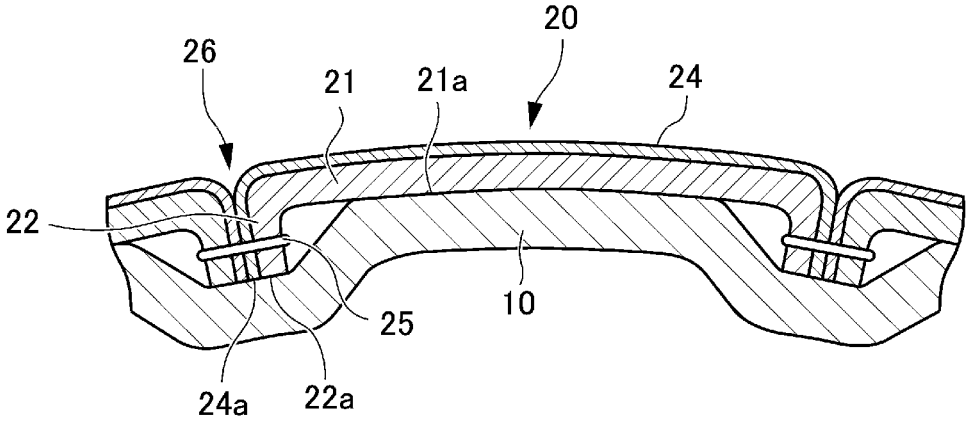
FIG. 3 is a view for explaining a state in which the skin regarding is formed by sewing (sewn ball) with respect to FIG. 2 (*a*).

Furthermore, a fourth embodiment may be configured as shown in FIG. 3. In the first to third embodiments described above, a so-called glued ball in which the skin layer 20 is adhered to the tube 10 and/or the skin layers 20 are attached to each other have been described, but the fourth embodiment is of a so-called sewn ball in which the skin layers 20 are stitched together. FIG. 3 shows an example of a sewn ball in which the entire surface of the skin layer 20 is covered with the water absorbent outer skin 24 like with FIG. 2(*b*). Here, a case in which the skin layer 20 does not have an extending portion 23 has been illustrated.

The peripheral wall portions 22 and the water absorbent outer skins 24 of each adjacent skin layer 20 are stitched together with sewing thread 25 (about 10,000 denier) in a state in which they folded inward by about 90 degrees. The edge surface 22*a* of the peripheral wall portions 22 of the skin layers 20 and the edge surfaces 24*a* of the water absorbent outer skins 24 and the inner surfaces 21*a* of the surface portions 21 of the skin layers 20 are adhered to the tube 10.

Moreover, the mode of imparting water absorbency to the skin layers 20 can also be applied to such a sewn ball, and for the sewn ball, since the skin layers 20 and the surface portions 21 are integrally sewn, the bonding strength increases. In contrast, because a glued ball is evenly warped even at the seams 26 when the entire ball is gripped by a hand, it is possible to further exert the effect of not slipping together with the function of absorbing the sweat of the hand.

(Reinforcing Layer)

Figure 4:
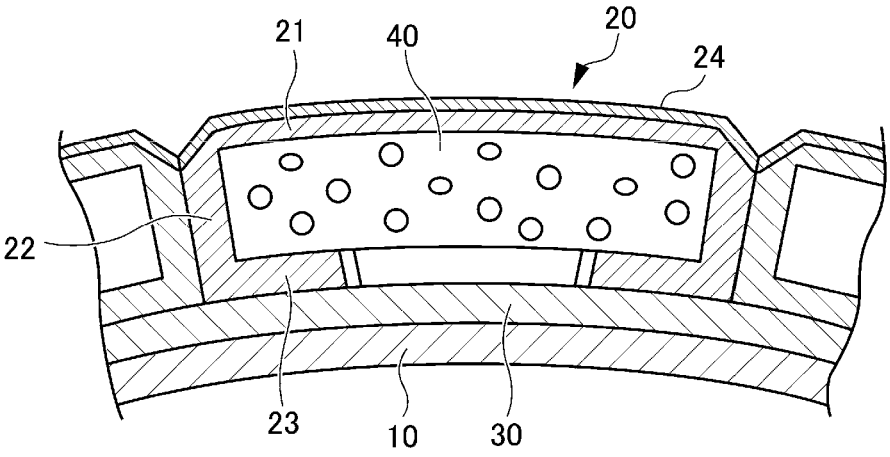
FIG. 4 is a view for explaining a case where a reinforcing layer and an intermediate layer are further provided in FIG. 2 (*b*).

As shown in FIG. 4, a fifth embodiment of the invention, the ball 1 may further include the following layer between the tube 10 and the skin layer 20 described above. For example, a reinforcing layer 30 may be provided so as to cover the outer surface of the tube 10 made of an elastic material such as butyl rubber or latex rubber. The reinforcing layer 30 is constituted by thread wound substantially uniformly around the entire tube 10. Examples of the thread include polyester, nylon, or cotton materials. Instead of thread, the reinforcing layer 30 may also be made of cloth or the like, or may be formed by combining thread and cloth.

(Intermediate Layer)

Furthermore, an intermediate layer 40 may be provided in the cavity portion 27 surrounded by the peripheral wall portion 22 of the skin layer 20. The intermediate layer 40 is made of a cushioning material such as a foamed resin, a nonwoven fabric, a rubber, an elastomer or the like, and serves as a cushion when the opposing team grips the thrown ball 1 along with having the effect of improving the feeling when a person grips the ball 1. Further, by changing the hardness of the intermediate layer 40 serving as the cushion layer, the feeling when a person grips the ball 1 can be adjusted. The thickness of the intermediate layer 40 is set to approximately 0.5 mm or more and 2.0 mm or less (however, there are cases when the thickness becomes approximately 0 mm or thickens to approximately 3.0 mm due to manufacturing variations). Additionally, the intermediate layer 40 may be, for example, foamed natural rubbers, foamed synthetic rubbers, or various foamed resins (for example, polyurethane).

Meanwhile, for embodiments 6 and 7, the skin layer 20 may be formed in such a manner that the extending portion 23 is not provided (see FIGS. 2 and 4).

Figure 5A:
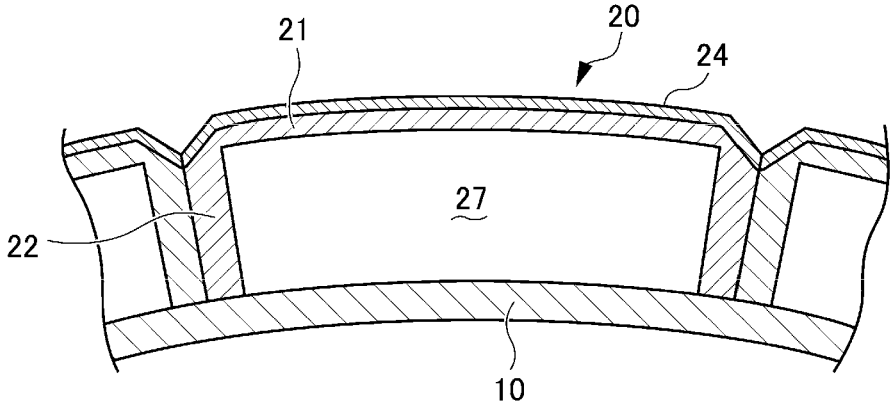
FIG. 5 is a view for explaining a case where the extending portion 23 is not provided, wherein (a) is a view for explaining a case where no intermediate layer is provided, and (b) is a view for explaining a case including an intermediate layer
Figure 5B:
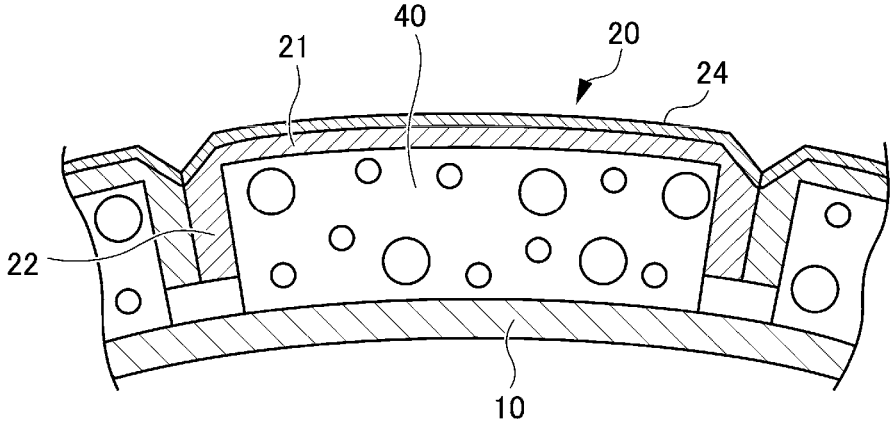

FIG. 5 is a figure for explaining a case in which the extending portion 23 is not provided, where FIG. 5(*a*) is shows a case in which the intermediate layer 40 is not provided, and FIG. 5(*b*) shows a case where the intermediate layer 40 is provided.

The sixth embodiment shown in FIG. 5(*a*) is different from the second embodiment (see FIG. 2(*b*) in that the extending portion 23 is not provided on the skin layer 20. The space surrounded by the surface portion 21, the peripheral wall portion 22, and the tube 10 is the cavity portion 27. Moreover, a water absorbent outer skin 24 is attached to the skin layer 20.

Further, the seventh embodiment shown in FIG. 5(*b*) is different from the embodiment shown in FIG. 4 in that the skin layer 20 is not provided with the extending portion 23. Then, in the space surrounded by the surface portion 21, the peripheral wall portion 22, and the tube 10, an intermediate layer 40 is provided. Moreover, a water absorbent outer skin 24 is attached to the skin layer 20.

In this manner, by forming the skin layer 20 in such a manner that the extending portion 23 is not provided, the skin layer 20 can be easily manufactured. Further, by forming the skin layer 20 in such a manner that the extending portion 23 is not provided, the rigidity of the skin layer 20 is lower than that of the embodiment in which the extending portion 23 is present, and the feeling when a person touches the surface portion 21 can be softened. Moreover, the edge surface 22*a* of the peripheral wall portion 22 may or may not be attached to the tube 10.

(Recessed Portion)

The skin layer 20 or the water absorbent outer skin 24 may be formed in a planar shape, but bottomed or bottomless recessed portions 28 may be provided. When recessed portions 28 are provided, water absorption is promoted, and since the fingertip can become caught in the recessed portions 28, further suppression of slipping when grasping the ball 1 is possible.

Figure 6A:
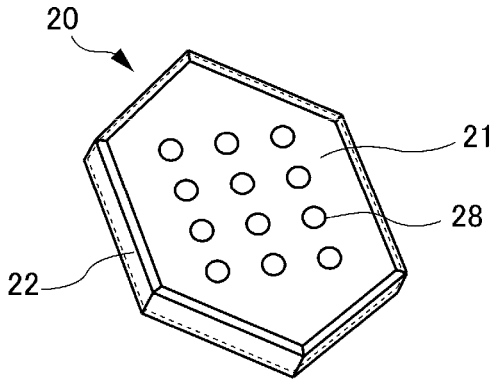
FIG. 6 is a view showing a case in which a bottomed recess is provided in a skin layer in FIG. 1, wherein (a) shows the entire skin layer, and (b) shows the cross section of (a).
Figure 6B:
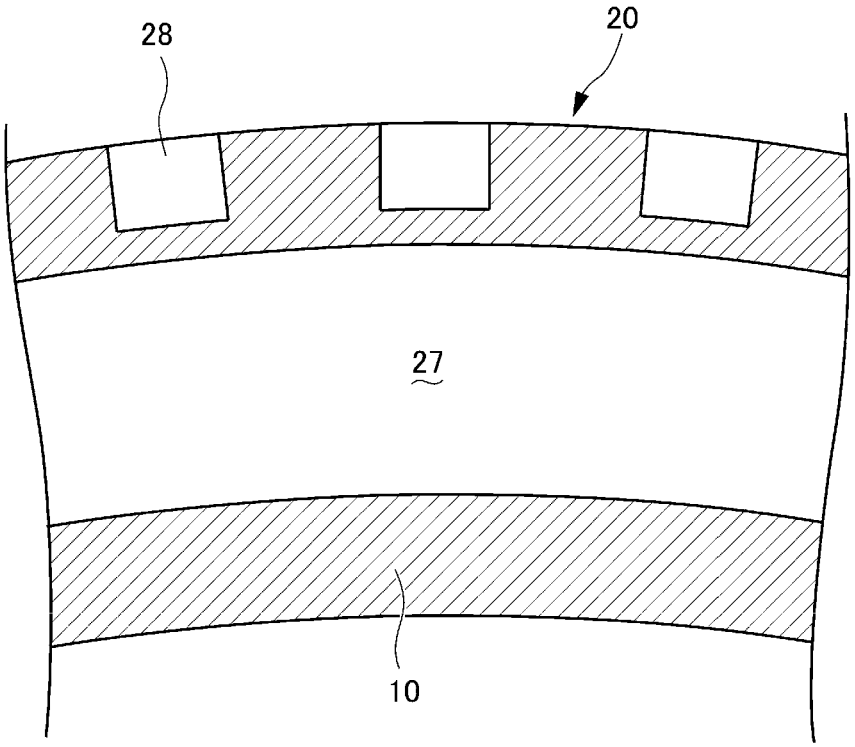

FIG. 6 shows an example of a case in which bottomed recessed portions 28 are provided in the skin layer 20. Here, bottomed recessed portions 28 are provided in the surface portion 21 of the skin layer 20. FIG. 6(*a*) shows a state in which the skin layer 20 is seen from the outside, and FIG. 6 (*b*) shows an enlarged cross-section. The way in which the recessed portions 28 are provided is not limited to the one shown.

(Tube Partitioning)

Figure 7:
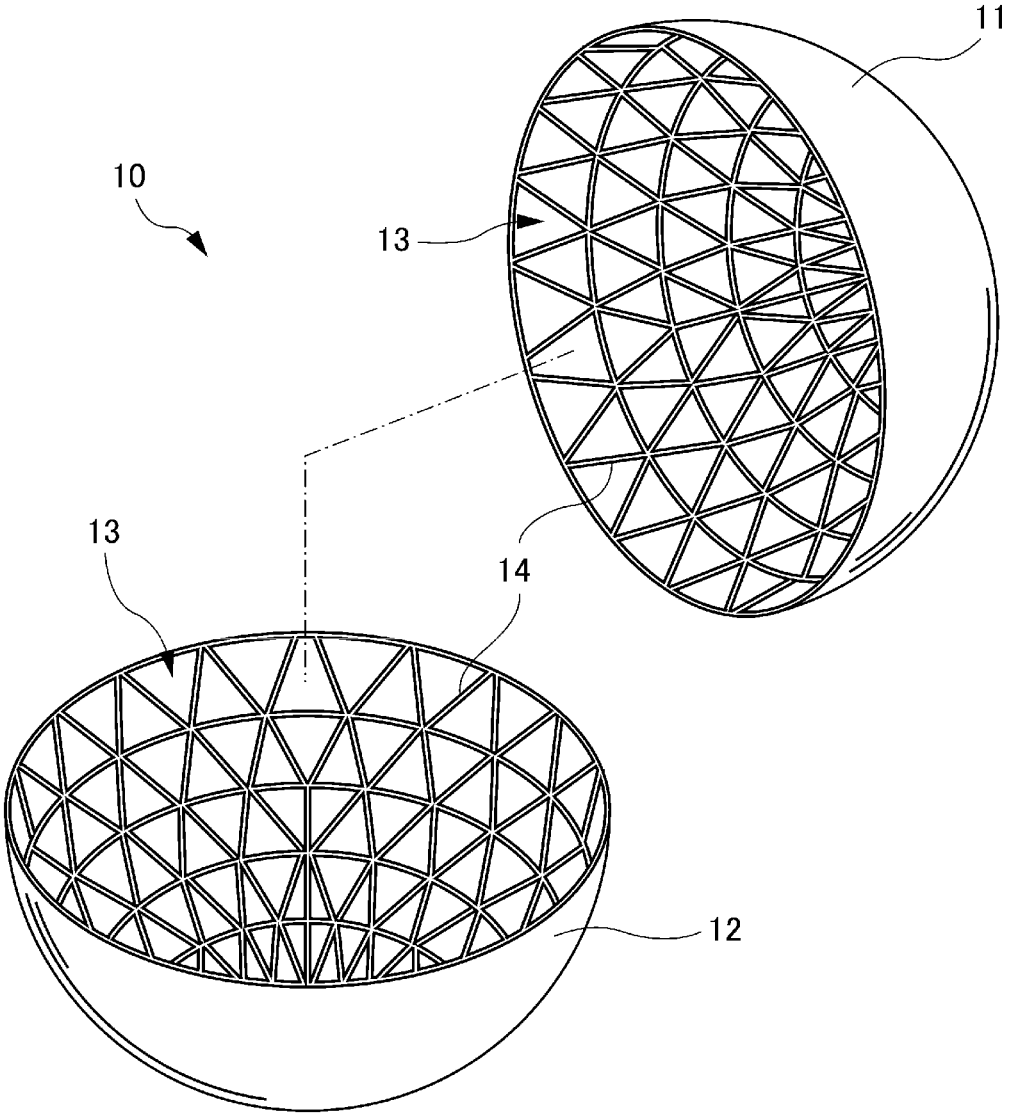
FIG. 7 is a view for explaining a case where the tube is composed of a divided body in FIG. 1.

In FIG. 1, a tube 10 constituted by one air bladder has been described, but as shown in FIG. 7, the tube 10 may have a configuration in which a two partitions divided into a first partitioned body 11 and a second partitioned body 12 are bonded to each other. When the tube 10 is composed of a first partitioned body 11 and a second partitioned body 12, this makes providing a ball 1 which has an internal rib structure 13 possible, making it is strong and easy to manufacture.

As shown in FIG. 7, the first partitioned body 11 and the second partitioned body 12 have a rib structure 13 on the inner wall surface thereof. Here, as an example of the rib structure 13, the protruding portions 14 are constituted by a triangular mesh. With such a configuration, even when the above-described reinforcing layer 30 is not provided on the surface of the tube 10, exhibiting uniform hardness as a whole is possible, and providing a ball 1 capable of exhibiting appropriate rebound properties during competition is possible Here, an example in which the protruding portions 14 of the rib structure 13 is configured to correspond to a truncated icosahedron (where the skin layers 20 comprise 20 regular hexagons and 12 regular pentagons) is shown. That is, the protruding portions 14 of the rib structure 13 are configured so that six triangles are formed in the region corresponding to the regular hexagonal skin layers 20 and five triangles are formed in the region corresponding to the regular pentagonal skin layers 20 (the triangles in the regular hexagonal region and the triangles in the regular pentagonal region have different sizes), and when configured in such a mesh shape, obtaining a balanced ball 1 is possible. However, the configuration of the rib structure 13 is not limited to this shape as long as it has a structure that can balance the ball 1 as a whole. For example, the protruding portions 14 may be formed in a discontinuous lattice shape, or may be configured in a spiral shape or the like.

Although the present invention has been described with reference to the embodiments, needless to say, the technical scope of the present invention is not limited to the scope described in the above embodiments. That various modifications or improvements can be added to the above embodiments would be obvious to persons skilled in the arts. Also, it is obvious from the description of the scope of the invention that embodiments in which such modifications or improvements are added can also be included in the technical scope of the present invention.

DESCRIPTION OF REFERENCE SYMBOLS

1 Ball
10 Tube
11 First Partitioned Body
12 Second Partitioned Body
13 Rib Structure
14 Protruding Portion
20 Skin Layer
21 Surface Portion
21*a* Inner Surfaces (of the Surface Portions 21)
22 Peripheral Wall Portion
22*a* Edge Surface (of the Peripheral Wall Portion)
23 Extending Portion
24 Water Absorbent Outer Skin
23*a* Edge Surfaces (of the Water Absorbent Outer Skin 24)
25 Sewing Thread
26 Seams
27 Cavity Portion
28 Recessed Portions
30 Reinforcing Layer
40 Intermediate Layer

The invention claimed is:

1. A ball comprising:
at least one skin layer with water absorption;
wherein the at least one skin layer includes a surface portion, a peripheral wall portion extending downward from a peripheral edge of the surface portion, and a water absorbent outer skin adhered to at least a part of the surface portion;
the surface portion and the peripheral wall portion are covered with the water absorbent outer skin; and
the at least one skin layer is a plurality of skin layers and adjacent skin layers of the plurality of skin layers are adhered or stitched together;
a hollow tube, the peripheral wall portion being connected to the hollow tube; and
a space surrounded by the surface portion, the peripheral wall portion, and the tube.

2. The ball according to claim 1, wherein the water absorbent outer skin has at least one bottomed recessed portion.

3. The ball according to claim 1, wherein the water absorbent outer skin is adhered to the entire surface of the surface portion.

4. The ball according to claim 1, wherein the water absorbent outer skin is formed of a water absorbent polymer, or a hydrophilic polymer.

5. The ball according to claim 1, wherein the water absorbent outer skin is porous.

6. The ball according to claim 1, wherein the ball is a glued ball in which the plurality of skin layers are adhered together.

7. The ball according to claim 1, wherein the tube is composed of a plurality of partitioned bodies welded or adhered together, the plurality of partitioned bodies each having a rib structure with protruding portions on an inner wall surface of the partitioned body.

8. The ball according to claim 1, further comprising a reinforcing layer provided between the tube and the at least one skin layer.

9. The ball according to claim 3, wherein the water absorbent outer skin is made of a polyurethane resin.

10. The ball according to claim 7, wherein the rib structure is constituted by a triangular mesh.

11. A ball comprising:
at least one skin layer with water absorption;
wherein the at least one skin layer includes a surface portion, a peripheral wall portion extending downward from a peripheral edge of the surface portion, and a water absorbent outer skin adhered to at least a part of the surface portion, the at least one skin layer has an extending portion extending from the peripheral wall portion toward the center;
the surface portion and the peripheral wall portion are covered with the water absorbent outer skin; and
the at least one skin layer is a plurality of skin layers and adjacent skin layers of the plurality of skin layers are adhered or stitched together;
a hollow tube, the at least one skin layer constitutes an outer layer of the tube, the extending portion being connected to the hollow tube; and
a space surrounded by the surface portion, the peripheral wall portion, the extending portion, and the tube.

12. The ball according to claim 11, wherein the water absorbent outer skin has at least one bottomless recessed portion.

13. The ball according to claim 11, wherein the water absorbent outer skin is adhered to the entire surface of the surface portion.

14. The ball according to claim 11, wherein the ball is a glued ball in which the plurality of skin layers are adhered together.

15. The ball according to claim 11, wherein the tube is composed of a plurality of partitioned bodies welded or adhered together, the plurality of partitioned bodies each having a rib structure with protruding portions on an inner wall surface of the partitioned body.

16. The ball according to claim 15, wherein the rib structure is constituted by a triangular mesh.

17. The ball according to claim 11, further comprising a reinforcing layer positioned between the hollow tube and the extending portion, wherein the hollow tube is connected to the reinforcing layer and the extending portion is connected to the reinforcing layer.

18. The ball according to claim 17, comprising an intermediate layer positioned in the space surrounded by the surface portion, the peripheral wall portion, and the extending portion.

19. The ball according to claim 11, wherein the water absorbent outer skin extends along the entire peripheral wall portion.

20. The ball according to claim 1, an intermediate layer positioned in the space, wherein the intermediate layer extends between two portions of the peripheral wall portion.

* * * * *